US006434791B1

(12) United States Patent
Chung

(10) Patent No.: US 6,434,791 B1
(45) Date of Patent: Aug. 20, 2002

(54) HINGES

(76) Inventor: Stanley Chung, 5430 Shannon Ridge La., San Diego, CA (US) 92130

( * ) Notice: Subject to any disclaimer, the term of this patent is extended or adjusted under 35 U.S.C. 154(b) by 0 days.

(21) Appl. No.: 09/549,784

(22) Filed: Apr. 14, 2000

(51) Int. Cl.[7] ..... E05D 5/02
(52) U.S. Cl. ..... 16/387; 16/389; 16/251
(58) Field of Search ..... 16/387, 250, 389, 16/388, 251

(56) References Cited

U.S. PATENT DOCUMENTS 2,619,673 A * 12/1952 Evans ..... 16/341
4,689,853 A * 9/1987 Marinoni ..... 16/382
4,937,916 A * 7/1990 Redman ..... 16/243
5,079,798 A * 1/1992 Burke et al. ..... 16/252
5,490,306 A * 2/1996 Floyd et al. ..... 16/250
5,867,869 A * 2/1999 Garrett et al. ..... 16/252
6,070,294 A * 6/2000 Perkins et al. ..... 16/252

* cited by examiner

*Primary Examiner*—Lynne H. Browne
*Assistant Examiner*—John B. Walsh
(74) *Attorney, Agent, or Firm*—Donn K. Harms

(57) ABSTRACT

A hinge has first and second hinge members interconnected by an axle that allows relative rotation between them. Each hinge member has screw holes allowing the hinge member to be connected to a leaf or a frame. The screw holes of one hinge member are protected by a cover that can only be removed when the hinge members have a specific relative disposition. This provides a security feature.

10 Claims, 4 Drawing Sheets

HINGES

BACKGROUND OF THE INVENTION

A known hinge comprises first and second hinge members interconnected for relative pivotal movement. The second hinge member includes a mounting member through which, in use, fixing means extend to fasten the mounting member to a surface with an end of the fixing means engaging the mounting means. For example, the fixing means might be in the form of screws that extend through holes in the mounting means.

It is a problem with such hinges that the mounting means are readily accessible. Where the hinge is used on a door, this means that the fixing means can be readily removed and the door forced open.

SUMMARY OF THE INVENTION

According to the invention, there is provided a hinge comprising first and second hinge members inter-connected for relative pivotal movement, the second hinge member including a mounting member through which, in use, fixing means extend to fasten the mounting member to a surface, with an end of said fixing means engaging said mounting means, a cover being provided which is movable relative to the mounting member between an inoperative position in which the cover exposes said end of said mounting means and an operative position in which said cover prevents access to said end of said mounting means, movement from said operative to said inoperative positions being prevented by said first hinge member except at one relative disposition of the first and second hinge members.

By providing a cover that can only be removed in one relative disposition of the hinge members, access to the fixing means is prevented during normal use of the hinge.

The following is a more detailed description of two embodiments of the invention, by way of example, reference being made to the accompanying drawing in which:

BRIEF DESCRIPTION OF THE DRAWING FIGURE

REFERRED EMBODIMENT OF THE INVENTION

Figure 1:
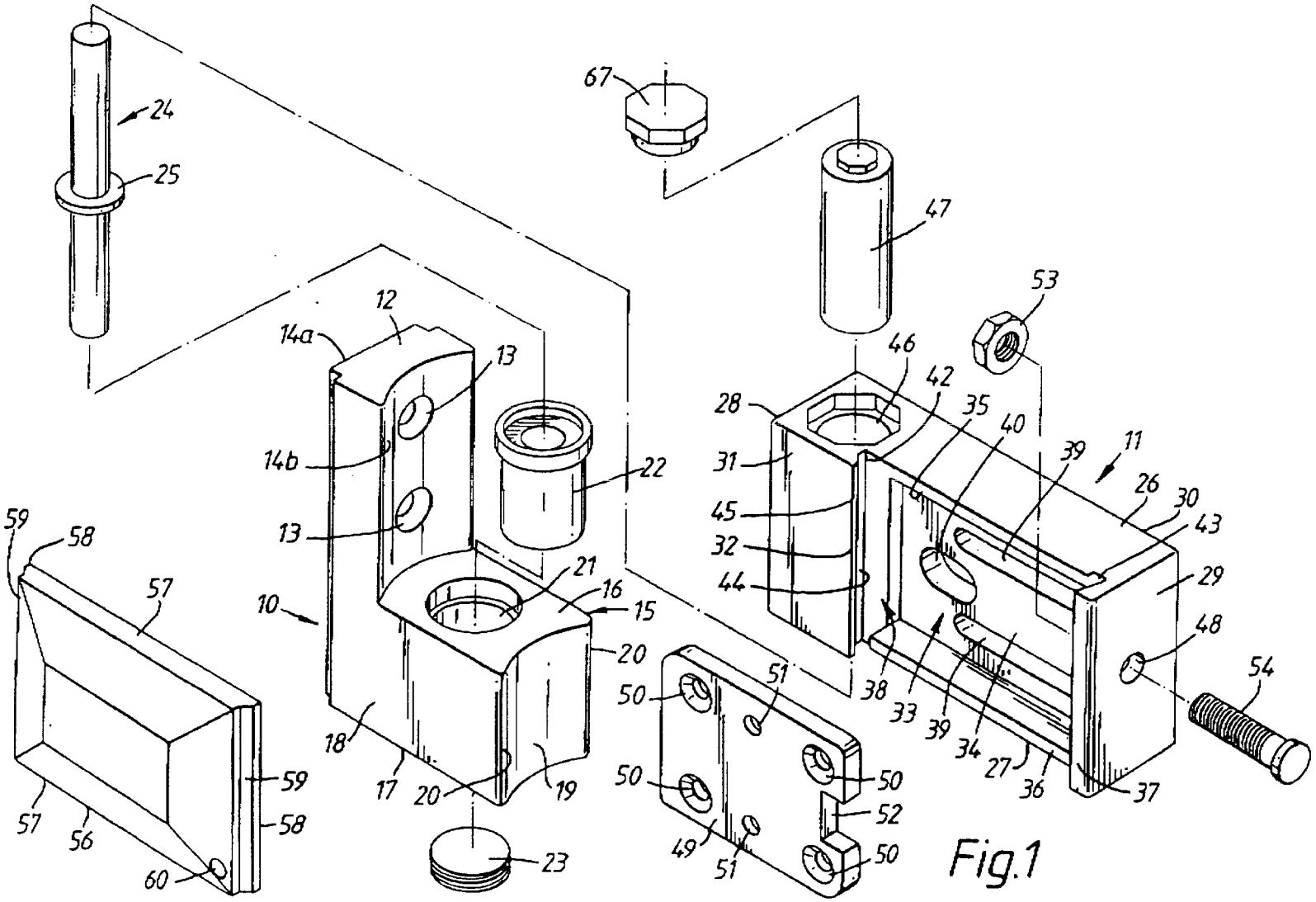
FIG. 1 is an exploded perspective view of a first form of hinge.

Referring first to FIG. 1, the first hinge comprises a first hinge member indicated generally at 10 and a second hinge member indicated generally at 11.

The first hinge member 10 is formed from metal and is generally L-shaped. One limb of the L-shape forms a mounting 12 provided with fixing holes 13 by which the first hinge member 10 can be connected to a surface with a mounting surface 14*a* of the first hinge member 10 against the surface. A surface 14*b* opposite the mounting surface 14*a* is concave. The second limb of the L forms a boss 15 which has parallel upper and lower surfaces 16,17 lying in respective planes parallel to the axis of the fixing holes 13 and normal to the mounting surface 14. These are interconnected by parallel side surfaces, one of which is seen at 18, and an end surface 19 extending between the side surfaces 18. The end surface 19 is concavely curved and forms a curved edge 20 with the upper surface 16 with two projections at respective opposite ends of the edge 20.

A hole 21 extends between the upper surface 16 of the boss and the lower surface 17 of the boss. The axis of this hole 21 is thus parallel to the mounting surface 14 and normal to the axes of the fixing holes 13. This hole 21 receives a bush 22 inserted from the upper surface 16. The end of the hole 21 at the lower surface 17 is closed by a cap 23 which screws into the hole 21 to allow adjustment of the vertical position of the bush 22.

An axle 24 is generally circular in cross section and has a central annular collar 25. One end of the axle is received in the bush 22 so mounting the axle for rotational movement about an axis co-axial with the axis of the hole 21

The second hinge member 11 is also made of metal. The second hinge member 11 is generally rectangular in shape with parallel spaced upper and lower surfaces 26,27 interconnected by parallel spaced end surfaces 28,29. The second hinge member 11 also has a rear surface 30 that extends between the upper and lower surfaces 26,27 and the end surfaces 28,29. The front surface 31 extends from one end surface 28 along only a portion of the length of the second hinge member 11 where it terminates in an edge 32. Between the edge and the opposite end surface 29, the second hinge member 11 is formed with a cavity to provide a mounting plate 33 having one side formed by the rear surface 30 and a parallel inner surface 34. The mounting plate 33 is bounded by a peripheral wall including an upper wall 35, a lower wall 36 and an end wall 37. The mounting plate 33 is also bounded by a step surface 38 extending between the edge 32 of the front surface 31 and the mounting plate 33.

The mounting plate 33 is formed with a pair of parallel slots 39 extending through the mounting plate 33 between the inner surface 34 and the rear surface 30 and also extending in a direction generally parallel to the upper surface 26 and the lower surface 27. An oval hole 40 is also provided in the mounting plate 33 extending between the inner surface 34 and the rear surface 30 and located adjacent the step surface 38 and between the slots 39.

The upper surface 26 and the lower surface 27 are cut away at their edges remote from the mounting plate 33 so that an edge of the end wall 37 projects beyond the upper wall 35 and the lower wall 36 at the front side of the second hinge member 11. In addition, this forms a rebate 42 in the step surface 38 with the rebate extending from the edge 32.

A slot 43 is provided along the projecting portion of the end wall 37 and a slot 44 is also provided in the rebate 42 extending along the edge 32. The slots 42,43 are thus parallel and extend in respective directions normal to the planes of the upper surface 26 and the lower surface 27 and normal to the lengths of the fixing slots 39. A flange 45 overlies the stepped surface 38 and has an edge curving over the rebate 42 towards the rebate slot 43. The function of these parts will be described below.

A portion of the second hinge member 11 between the rear surface 30 and the front surface 31 is provided with a hole 46 extending between the upper surface 26 and the lower surface 27. The axis of the hole 46 is thus parallel to the lengths of the slots 43,44 and parallel to the plane of the mounting plate 43. The hole 46 receives a cylindrical bush 47 which has a hole that receives the other end of the axle 24 beyond the collar 25. The open end of the hole 46 is closed by a cap 67. The hole in the bush 47 may be offset from the axis of the bush 47 so that rotation of the bush 47 results in lateral adjustment of the second hinge member 11.

In this way, the second hinge member 11 is mounted on the first hinge member 10 for rotational movement relative thereto about the axis of the axle 24. When so mounted, the lower surface 27 of the second hinge member 11 is closely adjacent the upper surface 16 of the boss 15. The arrangement is also such that when the mounting plate 33 lies in a plane which is parallel to the side surfaces 18 of the boss 15 (which is the assembled disposition of the parts shown in FIG. 1), the slot 43 adjacent the edge 32 is clear of the curved edge 20 between the end surface 19 and the upper surface 16 of the boss 15. However, as the second hinge member 11 is rotated from that position, this slot 43 overlies the upper surface 16 of the boss 15 due to the concave shape of the edge 20. The purpose of this will be described below.

The end wall 37 includes a hole 48.

The second hinge member 11 also includes an adjustment plate 49 formed of metal and generally rectangular in shape. A fixing hole 50 is provided at each corner of the plate and two locating holes 51 are provided adjacent longer edges of the adjustment plate between the adjacent fixing holes 50. One shorter edge of the adjustment plate 49 is provided with a rectangular cut-out 52.

The adjustment plate is sized to fit into the cavity surrounding the mounting plate 33 with a face of the adjustment plate 49 overlying the inner surface 34 of the mounting plate 33. When so positioned, two of the fixing holes 50 are aligned with one of the fixing slots 39 on the mounting plate and the other two fixing holes 50 on the adjustment plate 49 are aligned with the other fixing slot 39 on the mounting plate 33. Also when so positioned, a nut 53 fits in the cut-out 52 where it is held against rotation and a screw 54 extends through the end wall hole 48 and engages the nut so that rotation of the screw 54 moves the adjustment plate 49 relative to the mounting plate 33 in a direction normal to the axis of the axle 24 and parallel to the length of the fixing slots 39.

The second hinge member 11 also includes a cover 56. The cover 56 is formed of metal and is generally rectangular in shape with longer side edges 57 interconnected by shorter end edges 58. Each end edge 58 is provided with the respective flange 59. The lower end of one flange 59 is provided with a stop (not shown) whose purpose will be described below.

The flanges 59 are such that they are a sliding fit in the slots 43,44 adjacent the mounting plate 33. The presence of the stop ensures that the flanges 59 can only be engaged with the slots 43,44 at their ends adjacent the lower surface 27 and then slide along the slots until the side edges 57 of the cover are in register with the upper surface 26 and the lower surface 27 respectively. when in this disposition, the cover 56 prevents access to the adjustment plate 49 and the inner surface 34 of the mounting plate 33. It will be appreciated from what has been described above that the cover 56 can only be slid into this position when the second hinge member 11 is positioned relative to the first hinge member 10 as shown in FIG. 1, that is to say with the mounting plate 33 not in a plane normal to the side surfaces 18 of the boss 15. When the mounting plate 33 is normal to the side surfaces 18 of the boss 15, the cover 56 cannot be removed because the end of the slot 43 overlies the upper surface 16 of the boss 15, as described above.

The cover 56 is provided with a screw hole 60 at one corner which receives a screw (not shown) to lock the cover 56 to the remainder of the second hinge member 11.

In use, the hinge is for connecting a leaf, such as a door, to an associated fixed frame. The first hinge member 11 is connected to the frame by screws passing through the fixing holes 13. The first hinge member 10 is connected to the frame disassembled from the second hinge member 11 via the axle 24. This is to allow access to the fixing holes 13. Once the first hinge member 10 has been connected to the frame surface, the axle 24 and the second hinge member 11 are assembled to the first hinge member 10.

With the cover 56 removed, the second hinge member 11 is connected to the leaf by screws passing through the fixing holes 50 and the adjustment plate 49. The position of the leaf relative to the frame can be adjusted, before the screws are finally tightened, by rotating the screw 54 so moving the adjustment plate 49 relative to the mounting plate 33. The adjustment plate is guided in this movement by the pin 53.

The cover 56 is then replaced as described above. This provides a significant security feature in preventing access to the screws fixing the second hinge member 11 to the leaf. The screws fixing the first hinge member 10 to the frame are obscured by the second hinge member 11.

Referring now to FIGS. 2, 3, 4 and 5, the second hinge as shown in those Figures has a number of parts common with the first hinge shown in FIG. 1. Those parts will not be described in detail and will be given the same reference numerals in FIGS. 2, 3, 4 and 5 as they have in FIG. 1.

The principal difference between the hinges of FIGS. 2 to 5 and the hinge of FIG. 1 is in the construction of the adjustment plate referenced 60 in FIGS. 2 to 5 and 49 in FIG. 1. This necessitates associated changes in the mounting place 33.

Figure 3:
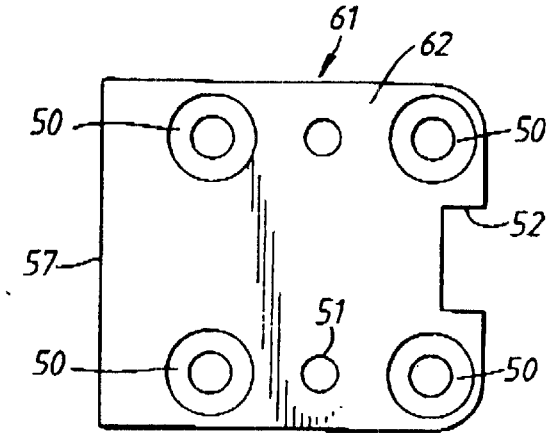
FIG. 3 is a side elevation of an adjustment plate of the second hinge.
Figure 4:
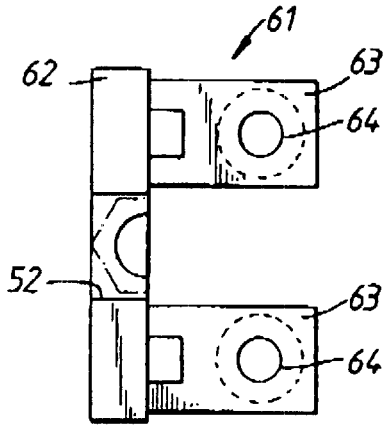
FIG. 4 is an end elevation of the adjustment plate of FIG. 3.
Figure 5:
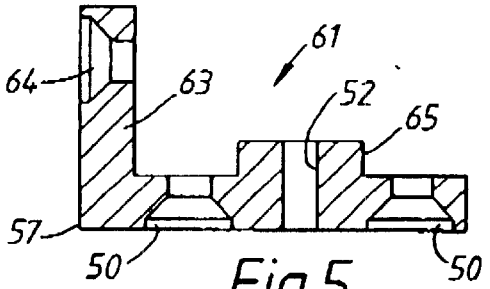
FIG. 5 is a cross-section through the adjustment plate of FIGS. 3 and 4.

The adjustment plate 61, best seen in FIGS. 3 to 5, has a generally rectangular body 62 provided with fixing holes 50 and locating holes 51 and a cut-out 52 (all seen in FIG. 3) in the same way as the adjustment plate 49 of FIG. 1. However, at the end of the mounting plate 61 opposite the cut-out 52, there are provided a pair of legs 63 (see FIG. 4) lying in respective planes normal to the plane of the body 62 and each adjacent a respective side edge 57 of the adjustment plate 61 so that the legs 63 are spaced apart. Each leg includes a fixing hole 64.

As seen in FIG. 5, each locating hole 51 is, at the surface of the body 62 adjacent the legs 63, surrounded by a projection 65.

Figure 2:
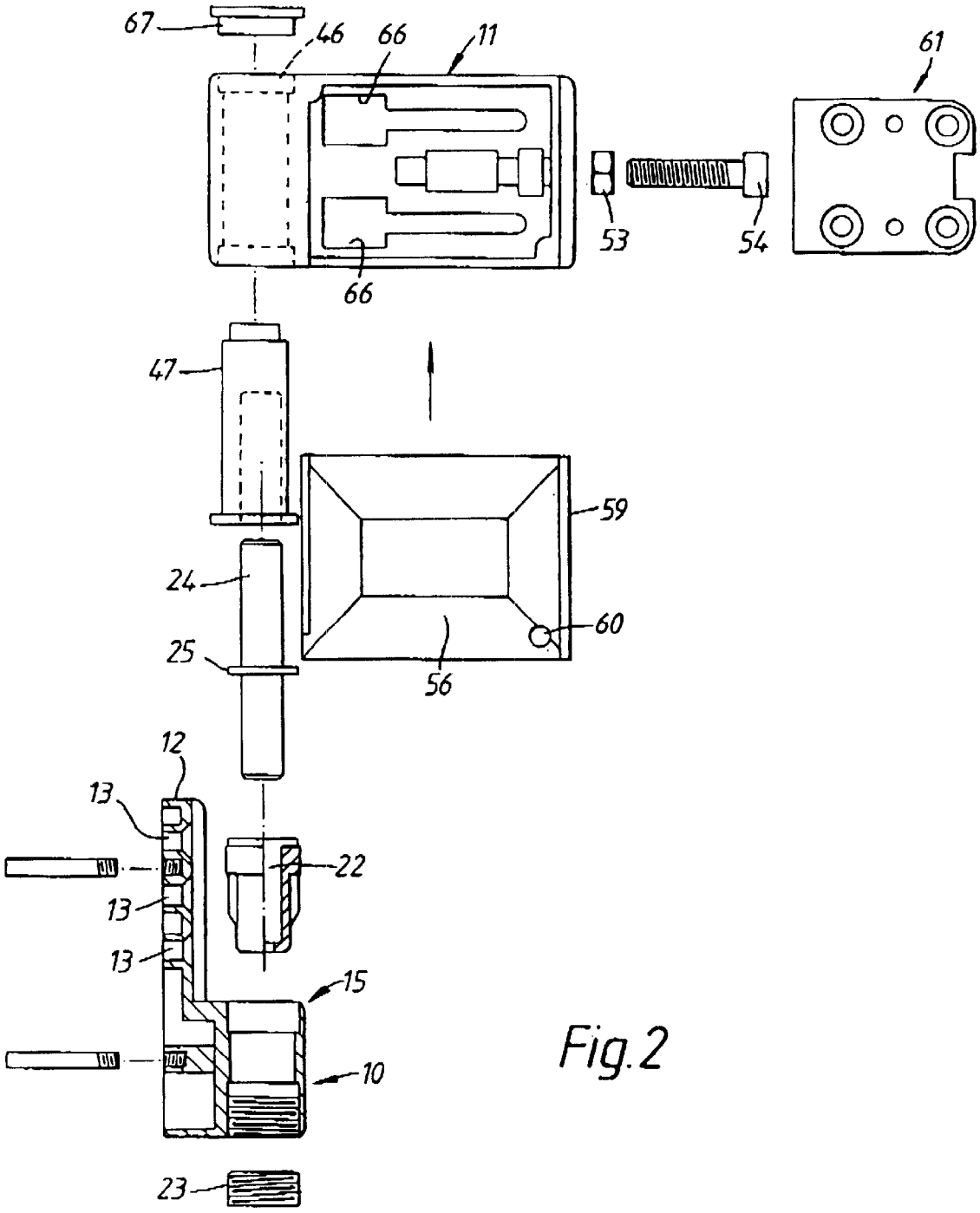
FIG. 2 is an exploded elevational view of a second form of hinge.

The use of this adjustment plate 61 requires modification of the mounting plate 33 as seen in FIG. 2. Referring to this Figure, it will be seen that the mounting plate slots 39 are, at their ends adjacent the axle 24, provided with enlarged rectangular apertures 66. This is so that the legs 63 can extend through these apertures 66 when the adjustment place 61 is positioned in the cavity and adjacent the mounting plate 63. The nut 53 fits into the cut-out 52 and engages the screw 54. Adjustment of the screw 54 moves the adjustment plate 61 relative to the mounting plate 33, consequently moving the legs 63 within the aperture 66. The projections 65 around the locating holes 51 engage in the mounting plate slots 39.

In use, the screws passing through the fixing holes 64 and the legs 63 can engage a surface of a leaf normal to the surface engaged by the screws passing through the fixing holes 50 in the body 62 of the adjustment plate 61. This provides additional security.

Figure 6:
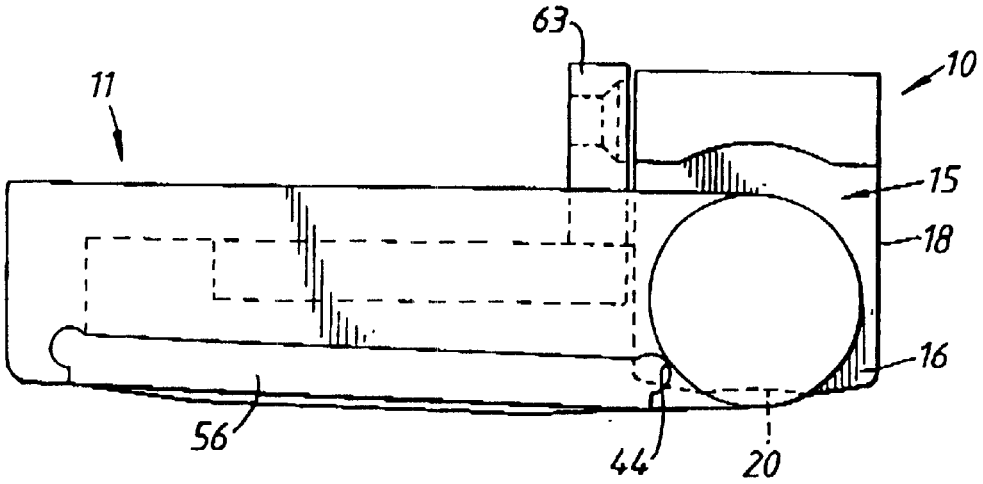
FIG. 6 is a plan view from above of the hinge of FIGS. 2 to 5 showing the hinge in a closed position.
Figure 7:
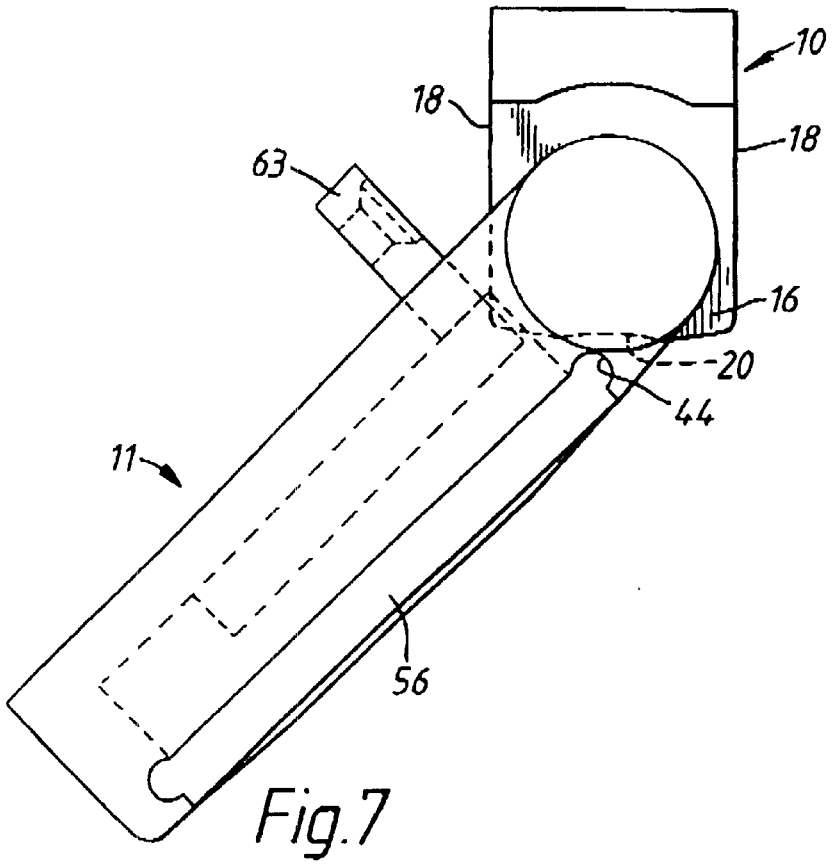
FIG. 7 is a plan view from above of the hinge of FIGS. 2 to 5 in a partly open position.

Referring to FIG. 6, the hinge of FIGS. 2 to 5, when in a closed position, has an edge 57, of the cover 56 and the associated slot 44 overlying the upper surface 16 of the boss 15. The cover 56 thus cannot be removed from the second hinge member 11. When rotated from this closed position, as seen in FIG. 7, the edge 57 and the associated slot 44, are clear of the surf ace 16, as a result of the presence of the concave edge 20, and the cover 56 can then be removed for access to the fixing screws.

It will be appreciated chat the adjustment plates 49,61 are optional. Screws, or any other convenient fixing means, could be passed direct through the mounting plate 33 into the leaf. Any ocher arrangement of cover may be used provided that it is arranged relative to the first hinge member so that the cover can only be removed in a particular relative disposition of the first and second hinge members 11,12.

What is claimed:

1. A hinge comprising first and second hinge members inter-connected for relative pivotal movement, the second hinge member including a mounting member through which, in use, fixing means extend to fasten the mounting member to a surface, with an end of said fixing means engaging said mounting member, a cover, said cover slidably engageable within a pair of slots located on said mounting member, said cover movable relative to said mounting member between an inoperative position in which the cover exposes said end of said fixing means and an operative position in which said cover is slidably engaged with said mounting member and prevents access to said end of said fixing means, movement from said operative to said inoperative positions being prevented by said first hinge member except at one relative disposition of the first and second hinge members.

2. A hinge according to claim 1 wherein said mounting member includes a mounting plate through which said fixing means passes, the mounting plate lying in a plane parallel to the hinge axis and being surrounded by a peripheral wall, the wall including said pair of slots which are mutually parallel and are parallel to said hinge axis, the cover having a pair of parallel flanges that are slidably engageable with said pair of slots so that the cover is movable between said inoperative and operative positions in a direction parallel to said hinge axis, said pair of parallel flanges when slidably engaged with said pair of slots thereby preventing removal of the cover in a direction normal to the plane of the plate.

3. A hinge according to claim 2 wherein said boss surface lies in a plane normal to said hinge axis and wherein said recess is a concave recess.

4. A hinge according to claim 2 wherein said cover closes the space circumscribed by the peripheral wall.

5. A hinge according to claim 2 or claim 4 wherein a screw carried by the cover engages the mounting member to lock the cover to the mounting member.

6. A hinge according to claim 2 wherein the first hinge member includes a boss projecting in a direction normal to the hinge axis, said boss including a shaped surface that prevents sliding movement of the cover from the operative position by engaging said cover as said sliding movement commences.

7. A hinge according to claim 6 wherein the boss surface includes a recess such that, when the first and second hinge members are in said one relative disposition, the cover can be slid from said operative to said inoperative position.

8. A hinge according to claim 1 wherein an adjustment plate overlies the mounting member with said fixing means extending through said adjustment plate and said mounting member, the adjustment plate and the fixing means being movable relative to the mounting plate in a direction normal to the axis of the hinge to allow adjustment of the hinge relative to said surface.

9. A hinge according to claim 8 wherein said mounting member includes a mounting plate through which the fixing means passes, the adjustment plate including a first portion lying on a plane parallel to said mounting plate and through which said fixing means passes and a second portion lying in a plane normal to the first portion and extending through the mounting plate, said second portion being connected to a surface normal to said first-mentioned surface.

10. A hinge according to claim 8 wherein said mounting member carries a screw which engages the adjustment plate so that screwing said screw into and out of the mounting member adjusts the position of said adjustment plate in said direction normal to the axis of the hinge.

* * * * *